US006378421B1

(12) United States Patent
Chiu

(10) Patent No.: US 6,378,421 B1
(45) Date of Patent: Apr. 30, 2002

(54) METHOD OF PRINTING AN INTEGRAL DESIGN ON THE LEAVES OF A BLIND WITH ONE ROUND OF PROCESSING

(76) Inventor: Chin-Yung Chiu, No. 2, Alley 25, Lane 25, Guojung 1st Rd., Dali City, Taichung (TW), 412

( * ) Notice: Subject to any disclaimer, the term of this patent is extended or adjusted under 35 U.S.C. 154(b) by 0 days.

(21) Appl. No.: 09/945,718

(22) Filed: Sep. 5, 2001

(51) Int. Cl.[7] ..... B41F 17/00; B41F 13/02

(52) U.S. Cl. ..... 101/35; 101/369; 101/373; 101/399; 101/487

(58) Field of Search ..... 101/369, 399, 101/487, 373, 35–44

(56) References Cited

U.S. PATENT DOCUMENTS 5,671,667 A * 9/1997 Simmet ..... 101/35

6,286,920 B1 * 9/2001 Ridgway ..... 347/2

* cited by examiner

*Primary Examiner*—Daniel J. Colilla
*Assistant Examiner*—Marvin P Crenshaw
(74) *Attorney, Agent, or Firm*—Troxell Law Office PLLC

(57) ABSTRACT

The method of printing an integral design on the leaves of a blind with one round of processing includes setting up printing plates for designs expected to be printed, and then the designs on these printing plates are compressed by a printing roller and printed on the leaves at the same time. Next, these leaves with printed designs on them are dried, collected and tied up, possible to produce by a large number with one round of processing, to lower processing cost and greatly beautify leaves of a blind.

6 Claims, 4 Drawing Sheets

METHOD OF PRINTING AN INTEGRAL DESIGN ON THE LEAVES OF A BLIND WITH ONE ROUND OF PROCESSING

BACKGROUND OF THE INVENTION

This invention relates to a method of printing a decorative design on the leaves of a blinds particularly to one possible to print an integral design on the leaves of a blind with one round of processing, possible to economize processing time and cost.

To increase an aesthetic feeling of the profile of a blind, various kinds of designs are printed on the leaves of the blind. A thermo-transfer printing method is commonly used for design processing. According to such method, designs expected to be printed are first made and processed on a thermo-transfer printing paper and then arrange the leaves of a blind in order and place them firmly on a mold. Next, put the thermo-transfer printing paper on the leaves of a blind and finally compress the mold of a thermo-transfer printing machine on the thermo-transfer printing paper by applying an extremely high printing temperature (between 200° C. and 250° C.) and high pressure to force the designs on the thermo-transfer printing paper transferred and printed on the surfaces of the leaves of a blind.

However, such a thermo-transfer printing method has some disadvantages described below.

1. In the processing of designs, the designs expected to be printed have to be transferred and printed on a thermo-transfer printing paper first to serve as transfer printing media, and this thermo-transfer printing paper becomes waste after used only once, impossible to be used again, thus not only increasing processing cost but resulting in environmental pollution as well.

2. In the process of thermo-transfer printing, extremely high temperature is absolutely needed for transfer printing so such method is comparatively applicable to aluminum alloy, but not suitable for such materials such as PVC unable to endure high temperature.

SUMMARY OF THE INVENTION

The objective of this invention is to offer a method of printing an integral design on the leaves of a blind with one round of processing, possible to save processing time and lower processing cost.

BRIEF DESCRIPTION OF DRAWINGS

This invention will be better understood by referring to the accompanying drawings, wherein.

DETAILED DESCRIPTION OF THE PREFERRED EMBODIMENT

Figure 1:
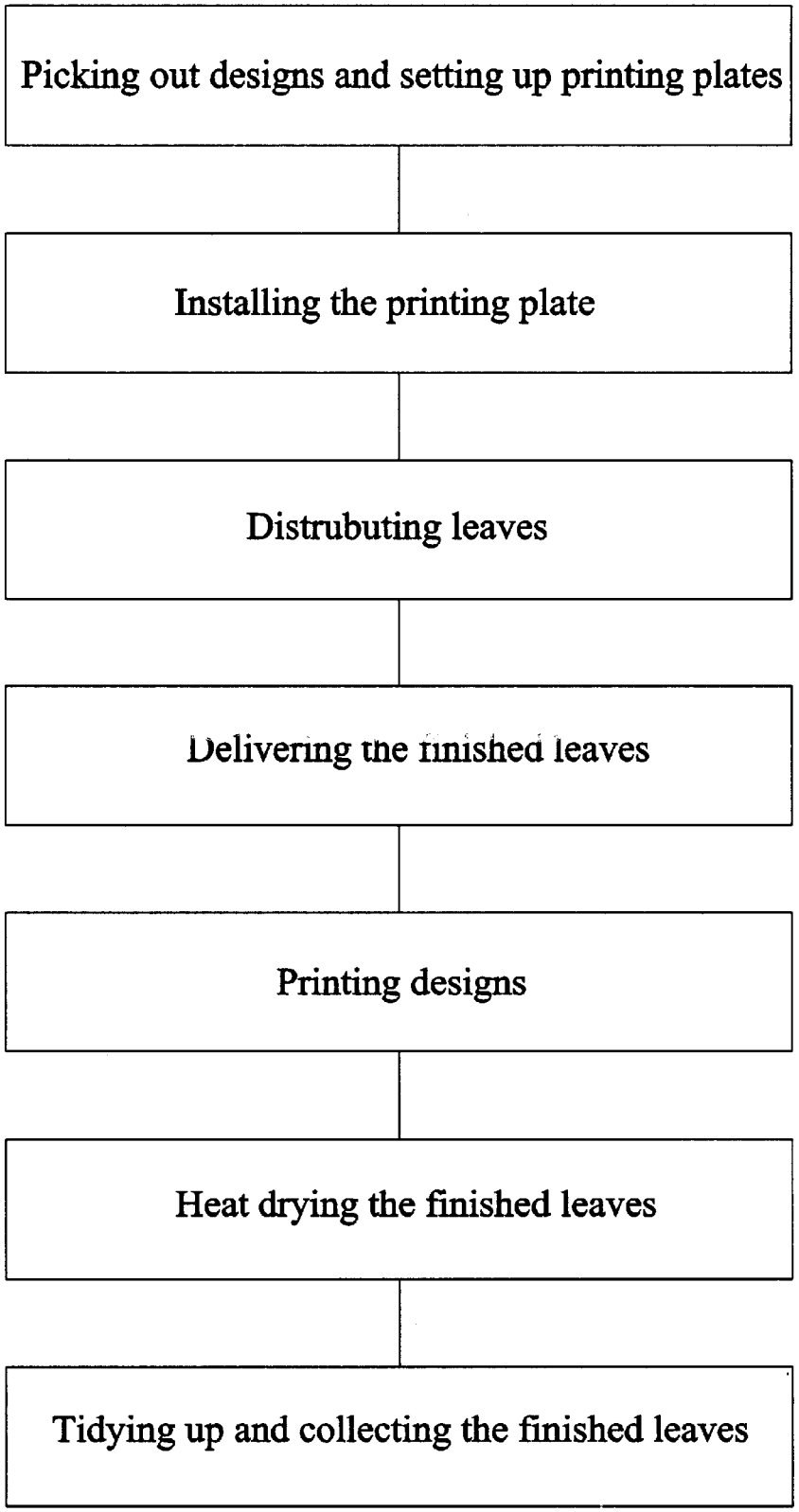
FIG. 1 is a block diagram of a preferred embodiment of the processing steps of printing an integral design on the leaves of a blind in the present invention.
Figure 2:
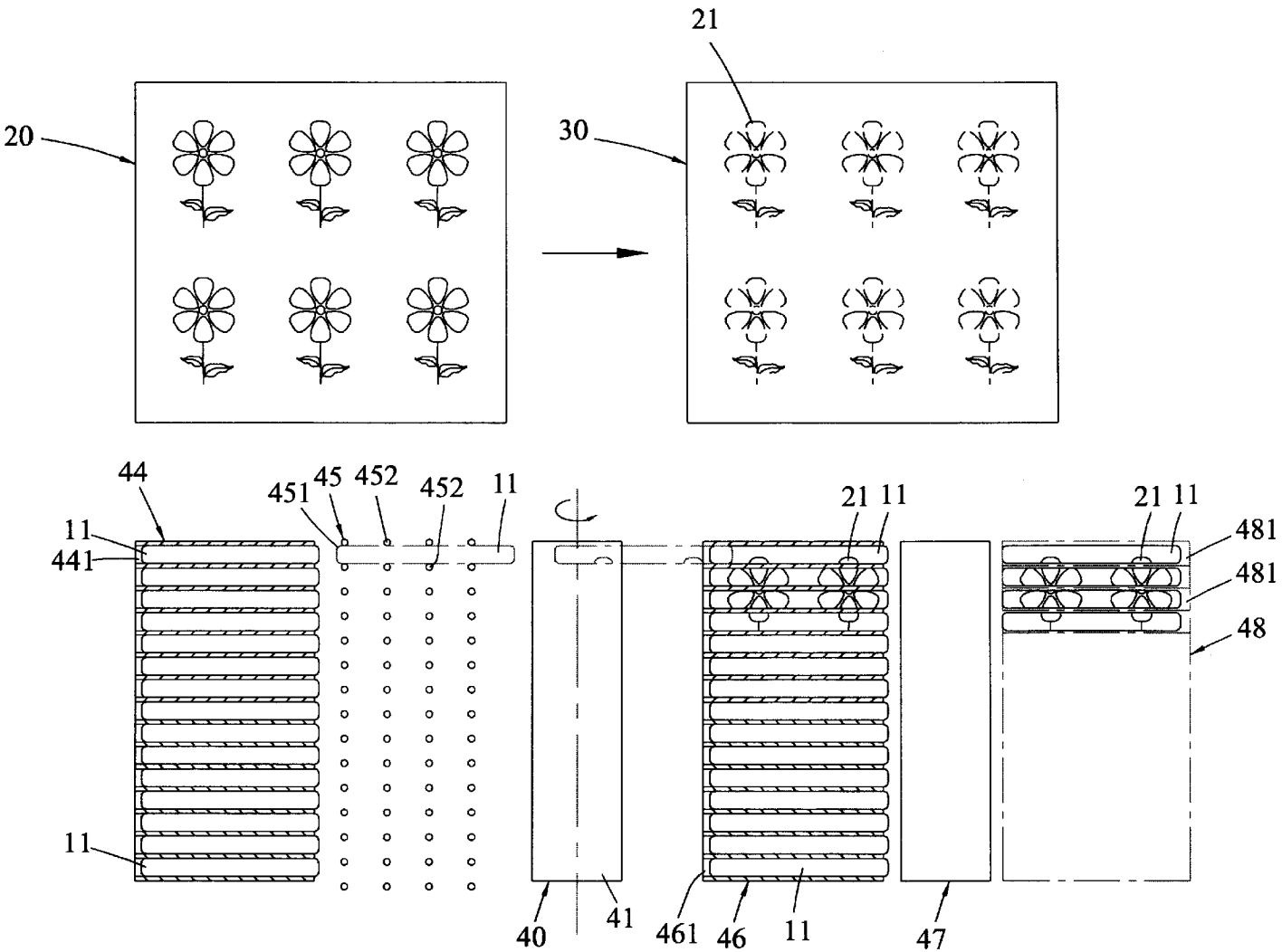
FIG. 2 is an upper view of the preferred embodiment of the process of printing an integral design on the leaves of a blind in the present invention.
Figure 4:
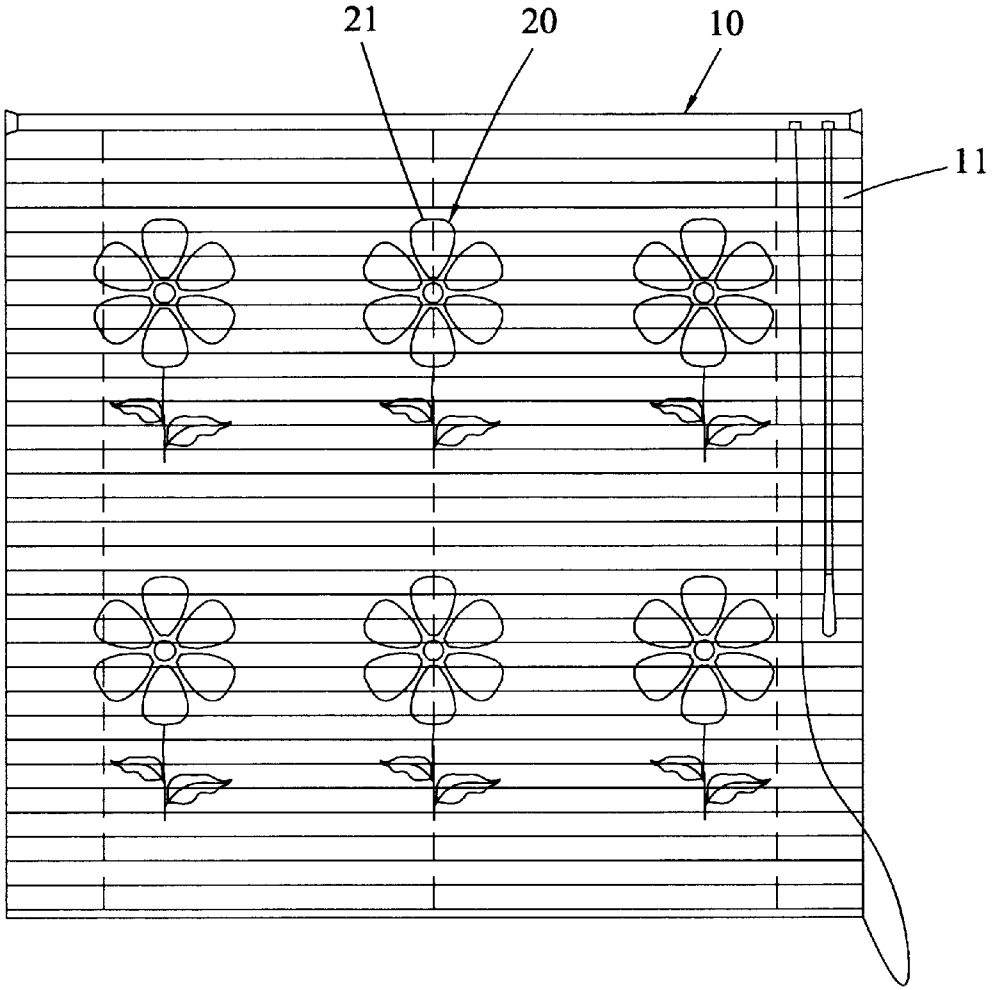
FIG. 4 is a front view of the preferred embodiment of the leaves of a blind printed with an integral design in the present invention.

A preferred embodiment of a method of printing an integral design on the leaves of a blind with one round of processing in the present invention, referring to FIGS. 1, 2 and 4, includes the following steps, (with the blind 10 and its leaves 11 made of aluminum alloy)

1. Selecting Designs and Setting Up Printing Plates

The designs to be printed on the leaves 11 of a blind 10 is first cut up into several small designs 21 which are then set up into printing plates and arranged orderly on a printing plate 30. When these small designs 21 are set up into printing plates, a certain space between every two small designs 21 has to be preset to allow every two adjacent designs capable to overlap each other a little so as not leave an extra white margin when these small designs 21 are printed on the leaves 11, thus enhancing integration of the designs.

2. Installing Printing Plates

Figure 3:
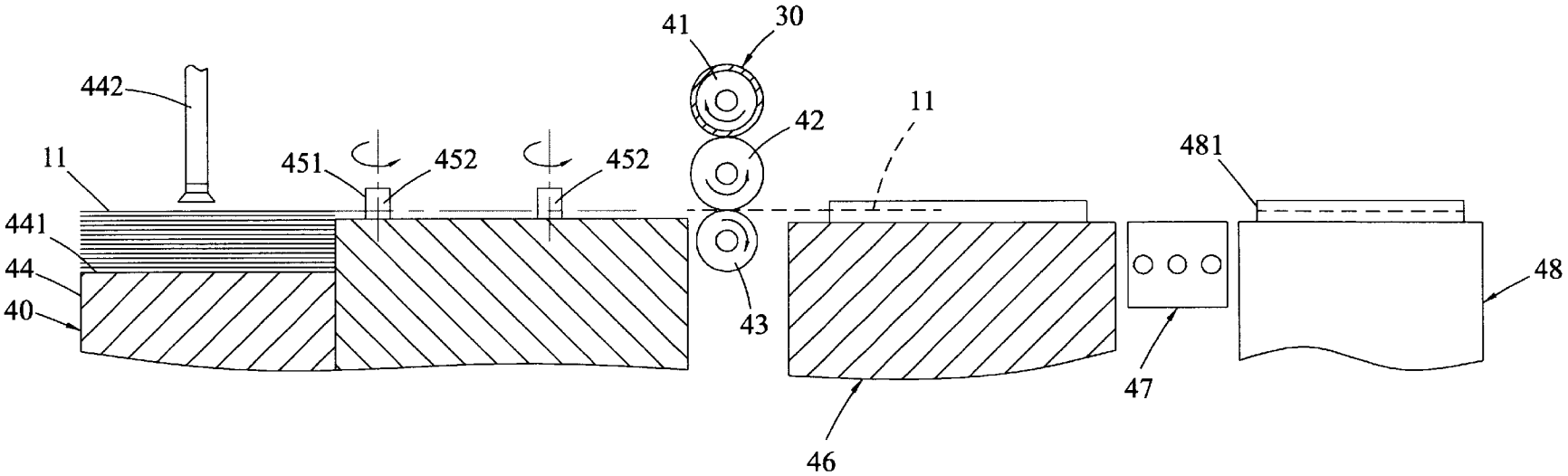
FIG. 3 is a side view of the preferred embodiment of the process of printing an integral design on the leaves of a blind in the present invention.

Referring to FIG. 3, the finished printing plates 30 are placed on a printing roller 41 of a printing device 40. This printing roller 41 engages a PU plastic wheel 42 under the printing roller 41, and they rotate together to activate a support wheel 43 under the PU plastic wheel 42 to rotate at the same time.

3. Distributing and Arranging Leaves

Leaves 11 of a blind 10, having the same sizes of the small designs 21, are picked and placed respectively in plural separated grooves 441 of the material distributing device 44 provided at the front portion of the printing device 40, with each separated groove 441 receiving an equal number of leaves 11.

4. Delivering the Leaves

An absorbing disk 442 having an absorbing function by means of gas pressure is provided above each separated groove 441 of the material distributing device 44. This absorbing disk 442 will orderly absorb the uppermost one of the leaves 11 and at the same time carry this leaf 11 to a rail space 451 of a material delivering device 45.

5. Printing Designs

Two driving wheels 452 are respectively provided on two opposite sides of the rail space 451 to contact with two side edges of the leaves 11 and push it forward to pass through between the PU plastic wheel 42 and the support wheel 43, and thus the small designs 21 are properly printed on the surface of each leaf 11.

6. Heat Drying the Finished Leaves

After the small designs 21 are printed on the leaves through the above-mentioned printing steps, these leaves 11 will be moved to a material-receiving device 46 provided beside the rolling wheel 41. The material-receiving device 46 has plural material receiving sections 461 spaced apart for placing the leaves 11. Besides, a heat-drying device 47 is connected to the material-receiving device 46 for drying the small designs 21 printed on each leaf 11 by heat.

7. Tidying Up and Collecting the Finished Leaves

After the leaves 11 with the small designs 21 are dried by heat, they are conveyed to the material-tidying groove 481 of a material-tidying device 48 and arranged in order therein and synchronously piled up, collected together and tied up stably, thus obtaining the leaves 11 of a blind 10 having an integral design on them.

In addition, the way of drying the finished leaves 11 printed with designs depends on what kind of printing ink is to be used. If solvent ink is used for printing, the heat-drying device 47 should be of a type of drying by hot wind, but, in case of UV (ULTRA VIOLT) ink to be used, the heat-drying device 47 should use a ultra-violet ray.

To sum up, this invention has the following advantages as can be noted from the above description.

1. The designs are directly printed on the leaves with colorful ink, so the designs printed are clear, bright and beautiful and also easy to be washed away.

2. The designs are duplicated in shape on printing plates for printing on the leaves, so the speed of printing process is much faster than that of a conventional thermo-transfer printing method, and the quality and quantity of products of this invention can hardly be achieved by any conventional method, thus elevating quality of products and lowering processing cost.

3. The printing plates used for printing designs on the leaves of a blind with ink can be used repeatedly, without a problem of environmental pollution caused by the thermo-transfer printing paper used in a conventional printing process.

While the preferred embodiment has been described above, it will be recognized and understood that various modifications may be made therein and the appended claims are intended to cover all such modifications that may fall within the spirit and scope of the invention.

I claim:

1. The steps of printing an integral design on the leaves of a blind with one round of processing comprising:

(1) Picking out designs and setting up printing plates: designs to be printed on the leaves of a blind cut up into several small designs, said small designs arranged on printing plates in order:

(2) Installing said printing plate: said printing plate placed on a printing roller of a printing device:

(3) Distributing leaves: said leaves of a blind having the same sizes of said small designs, picked and placed in plural separated grooves of a material distributing device, each said separated groove filled with a same number of said leaves:

(4) Delivering the finished leaves: an uppermost one of said leaves in said separated groove carried to a rail space of a material delivering device by means of said material distributing device of said printing device:

(5) Printing designs: said leaves in said rail space pushed in between said printing roller and a support wheel and printed with said small designs on them correspondingly:

(6) Heat drying the finished leaves: said leaves already printed with said small designs orderly moved to the material-receiving sections of a material-receiving device beside said printing roller, a heat drying device provided beside said material-receiving device for drying said small designs printed on said leaves:

(7) Tidying up and collecting the finished leaves: said leaves having been dried up orderly moved into a material tidying groove of a material tidying device to be piled up and collected and then tied up.

2. The method of printing an integral design on the leaves of a blind with one round of processing as claimed in claim 1, wherein, in setting up printing plates for said small designs, every two of said small designs are overlapped each other a little to avoid leaving an extra white margin.

3. The method of printing an integral design on the leaves of a blind with one round of processing as claimed in claim 1, wherein said leaves are made of aluminum alloy.

4. The method of printing an integral design on the leaves of a blind with one round of processing as claimed in claim 1, wherein said leaves are made of PVC.

5. The method of printing an integral design on the leaves of a blind with one round of processing as claimed in claim 1, wherein said heat drying device is of a style of drying by hot wind.

6. The method of printing an integral design on the leaves of a blind with one round of processing as claimed in claim 1, wherein said heat drying device is of a style of using an ultra-violet ray.

* * * * *